US009192848B1

(12) United States Patent
Martinez

(10) Patent No.: US 9,192,848 B1
(45) Date of Patent: Nov. 24, 2015

(54) LIGHTING APPARATUS FOR SKATE WHEEL

(71) Applicant: Jason S. Martinez, Salt Lake City, UT (US)

(72) Inventor: Jason S. Martinez, Salt Lake City, UT (US)

( * ) Notice: Subject to any disclaimer, the term of this patent is extended or adjusted under 35 U.S.C. 154(b) by 0 days.

(21) Appl. No.: 14/297,387

(22) Filed: Jun. 5, 2014

(51) Int. Cl.
*A63C 17/26* (2006.01)
*A63C 17/22* (2006.01)
*A63C 17/01* (2006.01)

(52) U.S. Cl.
CPC ..... *A63C 17/26* (2013.01); *A63C 17/014* (2013.01)

(58) Field of Classification Search
CPC .... A63C 17/00; A63C 17/0006; A63C 17/22; A63C 17/223; A63C 17/26; A63C 2203/14
USPC ..... 280/87.01, 87.021, 87.041, 87.042, 280/11.19, 11.203, 11.27; 301/5.301; 362/192, 473, 500, 800
See application file for complete search history.

(56) References Cited

U.S. PATENT DOCUMENTS

| | | | | |
|---|---|---|---|---|
| 4,298,910 | A * | 11/1981 | Price | 362/35 |
| 5,552,972 | A * | 9/1996 | Rezvani | 362/500 |
| 5,957,541 | A * | 9/1999 | Seigler | 301/5.301 |
| 6,337,528 | B1 * | 1/2002 | Jung | 310/168 |
| 6,398,395 | B1 * | 6/2002 | Hyun | 362/500 |
| 7,905,641 | B2 * | 3/2011 | Peckham, Jr. | 362/500 |
| 8,985,603 | B2 * | 3/2015 | Fissell | 280/87.042 |

* cited by examiner

*Primary Examiner* — John Walters
(74) *Attorney, Agent, or Firm* — Workman Nydegger

(57) ABSTRACT

A skate wheel cap and light apparatus for generating a light source can comprise an outer skate wheel cap structure. The outer skate wheel cap structure can comprise a first attachment point that is configured to attach to a portion of a skate wheel. Additionally, a power source can be integrated within the outer skate wheel cap structure. Further, the outer skate wheel cap structure can comprise a light source, which is electronically coupled to the power source.

5 Claims, 5 Drawing Sheets

LIGHTING APPARATUS FOR SKATE WHEEL

BACKGROUND OF THE INVENTION

1. Technical Field

This invention relates to systems, methods, and apparatus for using a light source within a skate wheel.

2. Background and Relevant Art

Skateboarding, rollerblading, and other similar sports have for many years been a common pastime for children and adults. For example, some individuals participate in street hockey using rollerblades. Some individuals enjoy skateboarding in skate parks where various tricks and stunts can be performed. Other individuals enjoy long boarding where often times the individual will skate down steep and prolonged hills.

Skating devices include a wide variety of different types and configurations of skates. For instance, skateboards, roller blades, four-wheel skates, long boards, razor scooters, and other related devices all fall within the category of skate devices. Each of these devices can be used to perform tricks, to recreate, or as a form of transportation.

One common factor in these various skate devices is the presence of skate wheels. Skate wheels can comprise a variety of different colors, sizes, compositions, and other attributes. For example, a skater desiring to perform tricks may prefer hard skate wheels. In contrast, a skater desiring to skate long distances at high speeds may prefer soft skate wheels. Additionally, as one will understand, various skaters may have preferences regarding particular brands of skate wheels, particular styles of skate wheels, particular colors of skate wheels, and/or other skate wheel specific features.

Regardless of the particular skate wheel that a skater chooses to use, skaters have the ability to skate in a variety of different locations. In many cases, skaters prefer to skate on public sidewalks and roads or in local parking lots. For example, a skater may choose to use a long board on roads or in bike lanes as a means for traveling locally or for commuting to and from work. The skater may use sidewalks and roads to cross intersections. In other cases, a skater may skate at an indoor skate park.

While some of the above mentioned activities may occur in specially designated state areas, many of these activities occur on public streets and sidewalks. One will appreciate that during lowlight conditions, such as night or early morning, it may be difficult for automobile drivers to see skaters. As such, accidents can happen that oftentimes lead to serious injuries or death to the relatively unprotected skater.

As such, recent efforts have been made to encourage skaters to wear protective gear, such as helmets. The use of such protective gear may help limit the damage that is caused when a skater is in an accident. While protective gear may help limit injury when a skater is an accident, one will understand that if an automobile hits the skater, the protective gear may only provide limited protection.

Accordingly, there is need in conventional skating for solutions that create greater visibility for skaters such that accidents can be prevented instead of simply mitigated.

BRIEF SUMMARY OF THE INVENTION

Implementations of the present invention comprise systems, methods, and apparatus configured to provide an easy to use light source to skaters. In particular, implementations of the present invention comprise a wheel cap that includes a power source and a light source configured to illuminate as a skate wheel spins. Additional implementations of the present invention include a light source and power source embedded into a skate wheel. In at least one implementation, the light source can be directed outward from an external surface of the skate wheel such that visibility is maximized.

For example, at least one implementation of the present invention can comprise a skate wheel and light apparatus for generating a light source. The skate wheel can comprise a rolling surface configured to make contact with a ground plane while the skate wheel is in use. The skate wheel can also comprise an outer sidewall surface configured to be outwardly visible when the skate wheel is connected to a skate device. Additionally, the skate wheel can comprise a through-hole configured to attach the skate wheel to an axle of the skate device. Further, the skate wheel can comprise a light source embedded within the skate wheel. The light source can be directed towards any surface of the skate wheel. The skate wheel can also comprise a power source within the skate wheel.

As an additional example of an implementation of the present invention, a skate wheel cap and light apparatus for generating a light source can comprise an outer skate wheel cap structure and an inner skate wheel cap structure. The outer skate wheel cap structure can comprise a first attachment point that is configured to attach to a portion of a skate wheel bearing or a skate wheel outer sidewall surface that is rotationally in sync with a rotation of a skate wheel. The outer skate wheel cap structure can also comprise a first portion of a generator. Additionally, the outer skate wheel cap structure can circumferentially surround the inner skate wheel cap structure. The inner skate wheel cap structure can comprise a second attachment point that is configured to attach to a portion of the skate wheel bearing or a portion of an axle that is not rotationally in sync with a rotation of the skate wheel. Additionally, the inner skate wheel cap structure can comprise a second portion of the generator. The skate wheel cap can also comprise a light source electronically coupled to the generator.

A further implementation of the present invention can include a skate wheel cap and light apparatus for generating a light source. The skate wheel cap can comprise an outer skate wheel cap structure. The outer skate wheel cap structure can comprise a first attachment point that is configured to attach to a portion of a skate wheel. Additionally, a power source can be integrated within the outer skate wheel cap structure. Further, the outer skate wheel cap structure can comprise a light source, which is electronically coupled to the power source.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above recited and other advantages and features of the invention can be obtained, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems, methods, and apparatus configured to provide an easy to use light source to skaters. In particular, implementations of the present invention comprise a wheel cap that includes a power source and a light source configured to illuminate as a skate wheel spins. Additional implementations of the present invention include a light source and power source embedded into a skate wheel. In at least one implementation, the light source can be directed outward from an external surface of the skate wheel such that visibility is maximized.

Accordingly, one or more implementations of the present invention provide a light source that can be seamlessly used with a skate device. For example, in at least one implementation, a skater can attach a magnet skate wheel cap to a skate wheel. In at least one implementation, the skate wheel cap can comprise a snap-fit that physically snaps to the skate wheel. The magnet skate wheel cap can comprise an integrated power source and light source. When the skate wheel is spun the light source can engage, such that the skate wheel cap projects lights. Additionally, in at least one implementation, the skate wheel cap allows a skater to use any skate wheel of their choice, while still having the skate wheel cap provide an illuminated light source.

As used within this application a skate wheel can include a wheel structure, the bearing, the truck, the axle, and the axle nut. In some cases, as used herein, a specific portion of the skate wheel (e.g., an axle nut) will be specified as a separate and distinct portion of the skate wheel. In contrast, in some situations, a specific portion of the skate wheel (e.g., a bearing) will be specified as merely an example portion of the skate wheel or to further clarify a particular aspect of the present invention. As such, reference to the "skate wheel" within this application should not be interpreted to limit the invention from being likewise associated with or incorporated with other specific portions of the skate wheel. Similarly, reference to specific features of the skate wheel within the application should not be interpreted as limiting the invention to association of incorporation with the particular feature, but instead may be only illustrative of a particular implementation.

Figure 1:
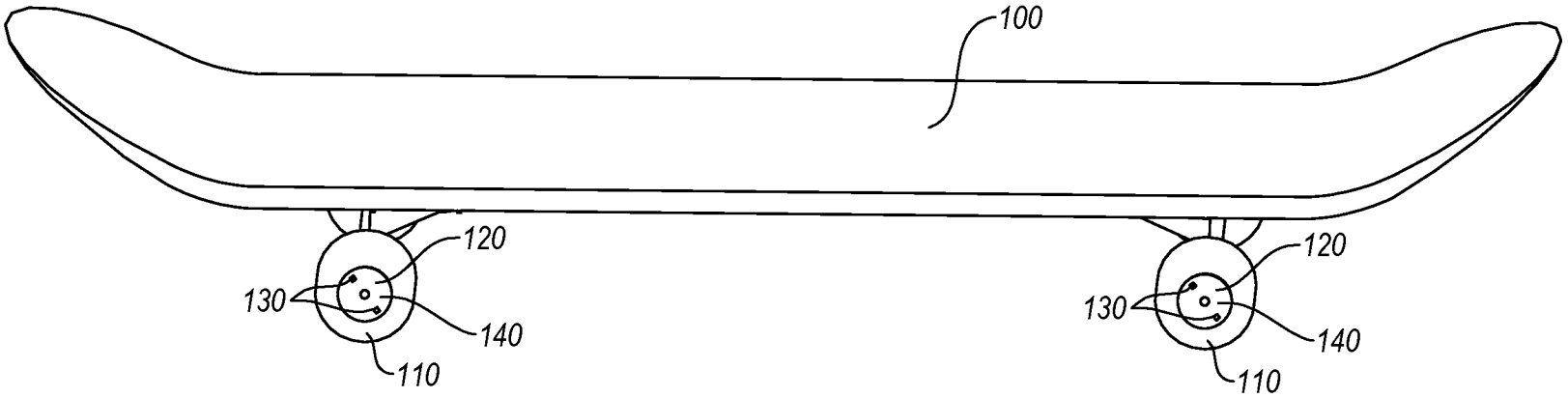
FIG. 1 illustrates a skateboard comprising a lighting apparatus in accordance with an implementation of the present invention.

Turning now to the figures, FIG. 1 illustrates a skateboard comprising a lighting apparatus in accordance with an implementation of the present invention. In particular, the skateboard 100 comprises a skate wheel 110 that is in communication with a wheel cap 120. The depicted wheel cap 120 includes multiple light sources 130. As will be described further below, in at least one implementation of the present invention the light sources 130 can illuminate such that a skater is more visible during lowlight conditions.

Additionally, implementations of the present invention apply equally to a variety of different skate devices 100. For example, implementations of the present invention can be used with skateboards, rollerblades, long boards, four-wheel skates, razor scooters, and any other device that uses skate wheels. Accordingly, one will understand that though a skateboard will be used as a primary example, the present invention applies equally to a variety of different skate devices.

Figure 2A:
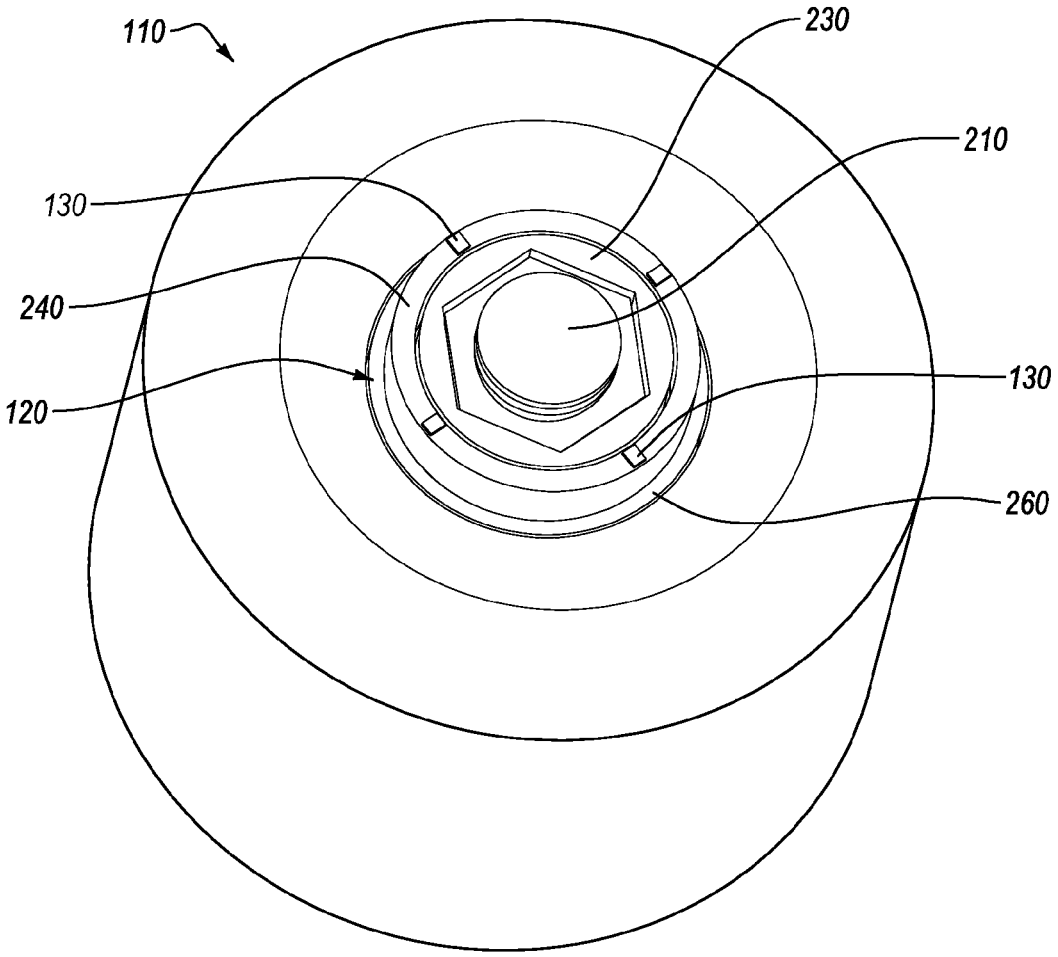
FIG. 2A illustrates a skate wheel and lighting apparatus in accordance with an implementation of the present invention.

FIG. 2A illustrates a skate wheel 110 and lighting apparatus in accordance with an implementation of the present invention. The depicted lighting apparatus comprises a wheel cap 120 that has been attached to the skate wheel 110. In this implementation, the wheel cap 120 comprises an inner skate wheel cap structure 230 and an outer skate wheel cap structure 240.

In at least one implementation, the inner skate wheel cap structure 230 can be configured to fit around an axle nut 140. The inner skate wheel cap structure 230 can also be configured to snap-fit to the axle nut 140 such that the inner skate wheel cap structure 230 is physically connected to the axle nut 140. The inner skate wheel cap structure 230 can comprise a magnetic component that is magnetically attracted to the axle nut 140. Additionally, in at least one implementation, the inner skate wheel cap structure 230 may not be shaped to receive the axle nut 140. For example, the inner skate wheel cap structure 230 may only cover a surface of the axle nut. One will understand that on a skate wheel 110, the axle nut 140 is rotationally stationary while the skate wheel 110 rotates. As such, in at least one implementation, the inner skate wheel cap structure 230 does not rotate when the skate wheel 110 rotates.

In at least one implementation, the outer skate wheel cap structure 240 can be configured to fit circumferentially around the inner skate wheel cap structure 230. The outer skate wheel cap structure 240 can comprise a magnetic component that is magnetically attracted to the bearing 260. Additionally, in at least one implementation, the outer skate wheel cap structure 240 can completely cover the inner skate wheel cap structure 230 such that the inner skate wheel cap structure 230 is not visible. One will understand that on a skate wheel 110 that at least a portion of the bearing 260 is rotationally synced with the skate wheel 110. As such, in at least one implementation, the outer skate wheel cap structure 240 rotates when the skate wheel 110 rotates.

Together, in at least one implementation, the outer skate wheel cap structure 240 and the inner skate wheel cap structure 240 can comprise a generator. For example, the outer skate wheel cap structure 240 can comprise a copper coil, and the inner skate wheel cap structure 230 can comprise a magnet. As such, when the skate wheel 110 spins, the rotation of the copper coil around the magnet can generate electricity. One will understand that the positioning of the copper coil and the magnet can be reversed and still generate electricity.

In at least one implementation, the generator can be in communication with one or more light sources 130. In the case of multiple light sources, a circuit board (not shown) may also be integrated within the generator to regulate the power to the light sources 130. Accordingly, as the skate wheel 110 spins electricity is generated and the light source can illuminate. As depicted in FIG. 2A, in the one or more light sources 130 can be integrated into the outer skate wheel cap structure 240. Additionally, in at least one implementation, the light source 130 can comprise an LED, a laser, incandescent bulbs, or any other electrically powered light source.

Further, in at least one implementation, the light source 130 can be positioned such that it is directed outwards from an outer sidewall of the skate wheel 110. This is in contrast to conventional implementations where the light source 130 may be embedded within a clear rubber wheel. In these conventional implementations, the wheel must be at least partially translucent to allow the light to escape. In contrast, in at least one implementation of the present invention, the wheel can be completely opaque and still function because the light source can be positioned at or directed to (e.g., through fiber optics) some point on the exterior of the skate wheel 110. For example, the light source 130 can be directed radially outward from the axle 210, such that the light source is directed towards the rolling surface of the skate wheel 110. Additionally, in at least one implementation, multiple light sources 130 can be positioned or directed towards various portions of the skate wheel 110 such that a polka-dot light effect is created.

Figure 2B:
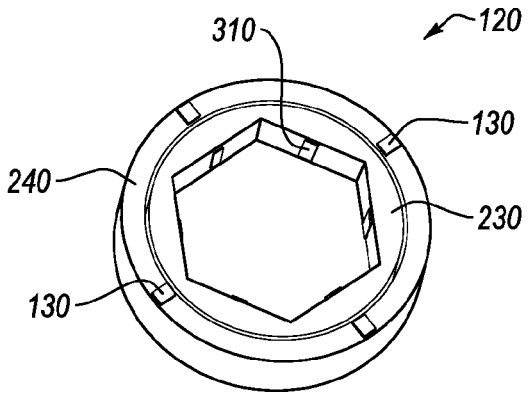
FIG. 2B illustrates the lighting apparatus of FIG. 2A in accordance with an implementation of the present invention.

FIG. 2B illustrates the wheel cap 120 of FIG. 2A in accordance with an implementation of the present invention. In particular, FIG. 2A depicts the wheel cap 120 separate from the skate wheel 110. Using features described above, the wheel cap 120 may comprise a stand-alone unit that can be easily attached to any skate wheel 120. For example, the outer skate wheel cap structure 240 and/or the inner skate wheel cap structure 230 can comprise attachments points 310 (e.g., magnet portions) that attach to the skate wheel 110, bearing 260, axle 210, and/or axle nut 220.

In alternative embodiments, the attachment points 310 can comprise interfaces other than magnetic. For instance, the attachment points 310 can comprise an epoxy or glue attachment, a physical connection (e.g., snap fit), a soldered connection, an adhesive connection, or any other connection type. As such, in at least one implementation, the wheel cap 120 is at least semi-permanently attached to the skate wheel 110 (e.g., when attached with solder). In contrast, in at least one implementation, the wheel cap 120 can be easily removed from one skate wheel 110 and applied to another skate wheel 110 without requiring additional tools or supplies (e.g., when attached magnetically). Additionally, in at least one implementation, the outer skate wheel cap structure 240 and the inner skate wheel cap structure 230 can comprise attachment points 310 of different types.

Regardless of attachment point 310 type, in at least one implementation, the wheel cap 120 is attached to the skate wheel 110 such that the outer skate wheel cap structure 240 and the inner skate wheel cap structure 230 do not rotate at the same rate when the skate wheel 110 is spinning. As described above, in at least one implementation, the inner skate wheel cap structure 230 is rotationally stationary because it is attached to the axle nut 140. In contrast the outer skate wheel cap structure 240 rotates in sync with the skate wheel 110 because it is attached to the bearing 260. Accordingly, in at least one implementation, a copper coil within the outer skate wheel cap structure 240 and a magnet within the inner skate wheel cap structure 230 are able to generate electricity and power the light sources 130 as they rotate with respect to each other.

As depicted in FIG. 2B, the inner skate wheel cap structure 230 comprises an axle-nut shape. Because many axle nuts 140 for skate wheels comprise the same dimensions, the inner skate wheel cap structure 230 may be configured to physically fit snugly over a standard skate wheel axle nut 140. In contrast, in at least one implementation, the inner skate wheel cap structure 230 is not shaped like an axle nut 140. For example, the inner skate wheel cap structure 230 can be shaped in a square or circle such that the inner skate wheel cap structure 230 can fit over a wide range of different axle nuts 140. Additionally, in at least one implementation, the axle nut 140 can be built into the inner skate wheel cap structure 230 such that the device can be used as an axle nut 140.

Additionally, in at least one implementation, the outer skate wheel cap structure 240 can be interchangeable with other outer skate wheel cap structures 240. For example, the outer skate wheel cap structure 240 can be connected to the inner skate wheel cap structure 240 by a semi-permanent connection. In addition, in at least one implementation, the outer skate wheel cap structure 240 can simply slide around the inner skate wheel cap structure 230 such that the two structures 230, 240 are held into place with respective to each other by their respective connections to the bearing 260 and axle nut 220.

In at least one implementation, it may be desirable to interchange the outer skate wheel cap structure 240 to achieve different effects and colors of light sources 130. For example, different outer skate wheel cap structures 240 may comprise different light sources colors, light patterns (e.g., blink patterns), different light sources types (e.g., LED, laser, incandescent, etc.), or other similar different features. As such, a skater may switch a first outer skate wheel cap structure 240 for an outer skate wheel cap structure 240 of a different configuration. In at least one implementation, the wheel cap 120 itself, or some portion 230, 240 of the wheel cap 120, determines the light source patterns (e.g., blinking). As such, in at least one implementation a user can interchange the outer skate wheel cap structure 240, the inner skate wheel cap structure 230, or the entire wheel cap 120 to achieve a different light source pattern.

Figure 3:
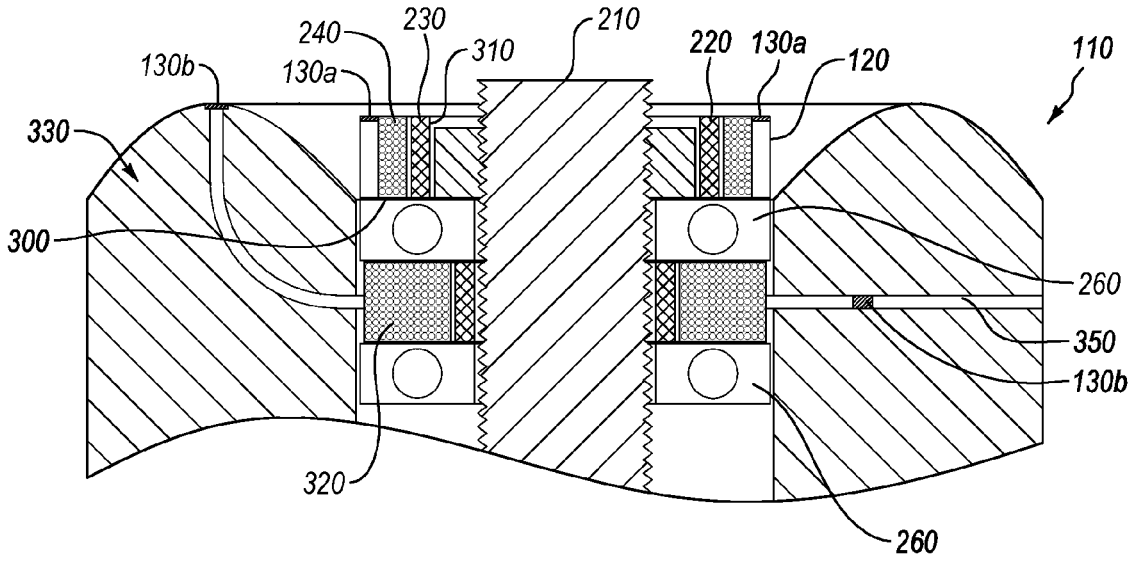
FIG. 3 illustrates a cross-sectional view of a skate wheel and a lighting apparatus in accordance with an implementation of the present invention.

FIG. 3 illustrates a cross-sectional view of a skate wheel 110 and a lighting apparatus in accordance with an implementation of the present invention. In particular, the depicted skate wheel 110 comprises a wheel cap 120 and an embedded light apparatus 320. Both the wheel cap 120 and the embedded light apparatus 320 comprise respective inner skate wheel cap structures 230 and outer skate wheel cap structure 240. Additionally, both the wheel cap 120 and the embedded light apparatus 320 comprise respective copper coils and magnets, such that the wheel cap 120 and the embedded light apparatus 320 can generate electricity when the skate wheel 110 spins. In at least one implementation, an insulator may be positioned between the magnet and the copper coils to prevent the coils from inadvertently discharging.

In the depicted implementation, the wheel cap 120 comprises one or more light sources 130(*a*) disposed on the outer skate wheel cap structure 240. The light sources 130(*a*) are in communicate with a copper coil disposed within the outer skate wheel cap structure 240. As described above, as the skate wheel 110 spins, the copper coil and magnet can generate electricity and provide power to the light sources 130(*a*).

Additionally, FIG. 3 also depicts various attachment points 300, 310 that can attach various portions of the wheel cap 120 to the skate wheel 110. For example, attachment point 310 may comprise an epoxy connection that connects the inner skate wheel cap structure 230 semi-permanently to the axle nut 220. Similarly, attachment point 300 may comprise a magnetic connection that magnetically connects the outer skate wheel cap structure 240 to the wheel bearing 260.

In at least one implementation, the embedded light apparatus 320 is disposed within the skate wheel 110 and between a first and second bearing 260. Similar to the wheel cap 120, the embedded light apparatus can comprise an inner skate wheel cap structure 230 that is attached to the axle bolt and an outer skate wheel cap structure 240 that is attached to one or both of the bearings 260. Either or both of the attachments can comprise an epoxy or glue attachment, a physical connection, a soldered connection, an adhesive connection, or any other connection type. For example, in at least one implementation the attachments for the embedded light apparatus 320 comprise a squeeze fit created by the axle nut 240 squeezing the embedded light apparatus 320 between the two bearings 260.

In at least one implementation, the embedded light apparatus 320 can be useful when the wheel cap 120 does not produce enough electricity to power the desired light sources 130(*a*), 130(*b*). Additionally, in at least one implementation, the embedded light apparatus 320 can be in electrical communication with one or more light sources 130(*b*) that are embedded within the skate wheel 110, instead of the outer skate wheel cap structure 240. In particular, the light sources can be positioned such that the light emitted from the light sources 130(*b*) is directed outward a surface of the skate wheel 110.

This positioning is in contrast to light sources that are embedded within clear skate wheels. In particular, in conventional clear skate wheels, the skate wheel must be at least partially transparent for the light to escape. In many cases, clear wheels are only suitable for indoor use because outside use with stain and dirty the clear wheels, rendering them opaque. In implementations of the present invention, the light source 130(*b*) can be positioned on the actual surface of the skate wheel 110, or the light source can be embedded within the skate wheel 110 but have a light guide 350 (e.g., fiber optic) that guides the light to a surface of the skate wheel 110. As such, implementations of the present invention can be used even with opaque wheels. In at least one implementation, it may be beneficial to direct the light outward from the outer sidewall surface 330 of the skate wheel 110 for the purposes of greater illumination.

In at least one implementation, the embedded light apparatus 320 can be a permanent part of a skate wheel 110. In addition, in at least one implementation, the light sources 130(*b*) embedded within the skate wheel 110 may be interchangeable with light sources of different colors, different types, or other different attributes. For example, a user may be able to remove the light source 130(*b*) itself from the skate wheel 110 and replace it with another light source 130(*b*) of interest. Additionally, in at least one implementation, the entire embedded light apparatus 320, or any portion 230, 240 of the embedded light apparatus 320, may be interchangeable to achieve different light source effects. For example, in at least one implementation, the embedded light apparatus 310, or a portion thereof 230, 240, may determine the blink pattern or intensity of the light sources 130(*b*). As such, a skater desiring a different pattern or intensity can interchange the entire embedded light apparatus 320, or just the appropriate portion thereof.

Figure 4:
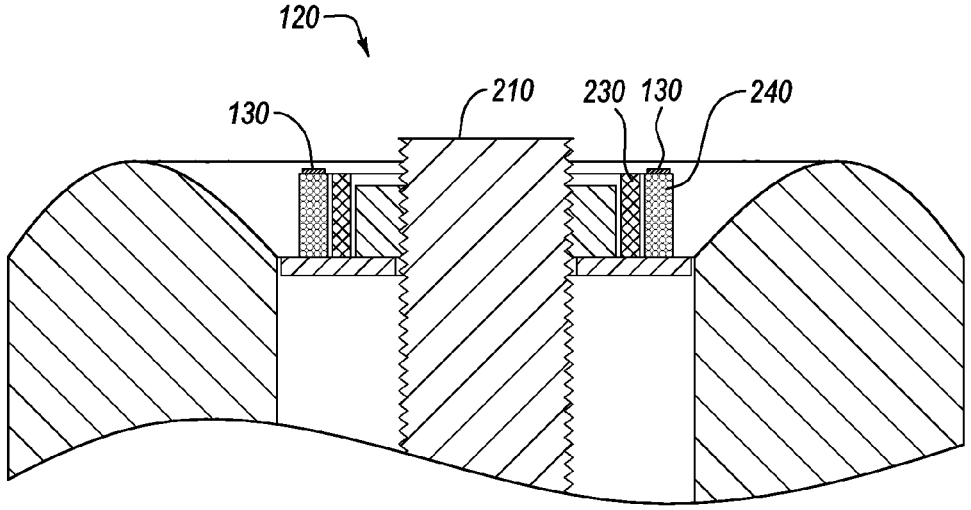
FIG. 4 illustrates a cross-sectional view of another implementation of a skate wheel and a lighting apparatus in accordance with an implementation of the present invention.

FIG. 4 illustrates a cross-sectional view of another implementation of a skate wheel and a lighting apparatus in accordance with an implementation of the present invention. The wheel cap 120 in FIG. 4 is similar to the wheel cap 120 in FIG. 3, except that in the wheel cap 120 of FIG. 4, the copper coil and the magnet have been interchanged such that the outer skate wheel cap structure 240 comprise the magnet and the inner skate wheel cap structure 230 comprises the copper coil. One will understand that interchanging the magnet and the copper coil will not impact the generation of electricity by the wheel cap 120. In at least one implementation, however, if the light source 130 is embedded within the outer skate wheel cap structure 240, an electrical crossover may be needed to connect the copper coil from the inner skate wheel cap structure 230 to the light source 130 on the outer skate wheel cap structure 240.

Figure 5:
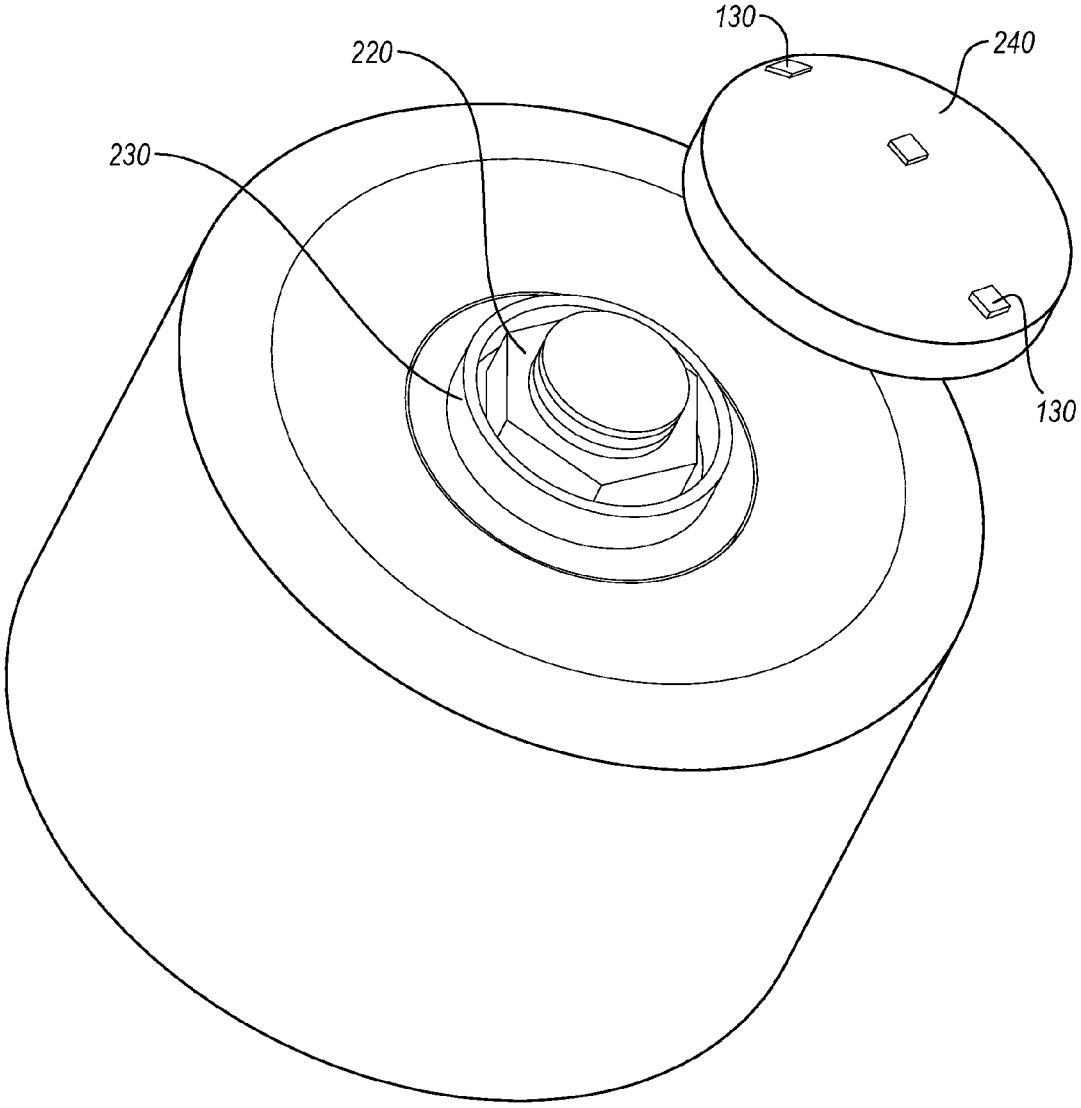
FIG. 5 illustrates another implementation of a lighting apparatus in accordance with an implementation of the present invention.

FIG. 5 illustrates another lighting apparatus in accordance with an implementation of the present invention. In the depicted implementation, a wheel cap 120 comprising one or more light sources 130 is placed over an axle nut 220. In at least one implementation, the axle nut 140 itself can be a magnet. As such, in at least one implementation, the axle nut 140 can comprise the inner skate wheel cap structure 230 and the depicted wheel cap 120 can comprise the outer skate wheel cap structure 240.

For example, in at least one implementation, a magnetic axle nut 140 can be provided to a skater. The skater 140 can attach any skate wheel 110 of choice to their skate device. The skater 140 can then attach the wheel cap 120 of FIG. 5 to the skate wheel 110. The outer skate wheel cap structure 240 can attach to the skate wheel 110 or the bearing 260. As the skate wheel 110 spins the outer skate wheel cap structure 240 can spin around the magnetic axle nut 220 and generate electricity that powers the one or more light sources 130. Accordingly, a skater can interchangeably apply a number of different outer skate wheel cap structure 240 to magnetic axle nut 220 of the present invention.

Figure 6A:
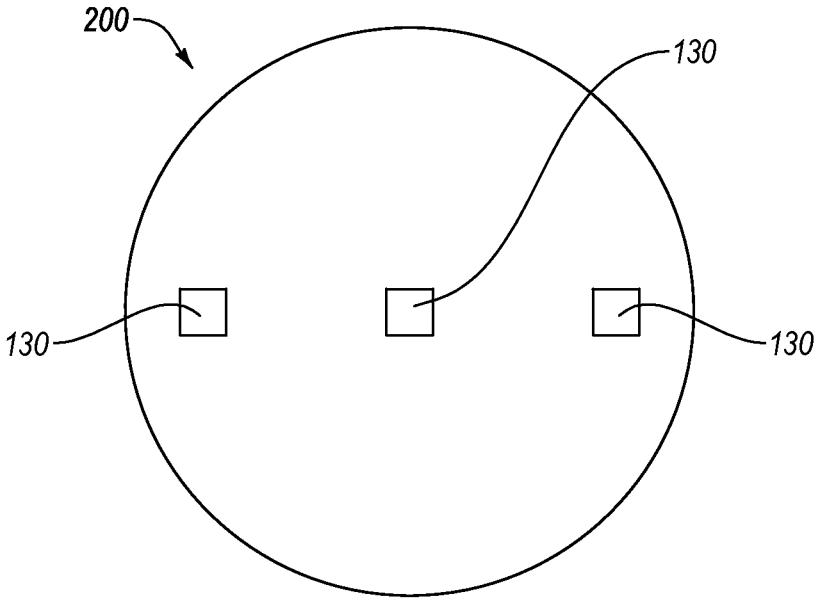
FIG. 6A illustrates a lighting apparatus in accordance with an implementation of the present invention.

FIG. 6A illustrates an implementation of a lighting apparatus in accordance with an implementation of the present invention. The depicted lighting apparatus comprises a wheel cap 120 that completely covers the axle nut 220. In at least one implementation, the wheel cap 120 can comprise a design across its face, in addition to one or more light sources 130.

Figure 6B:
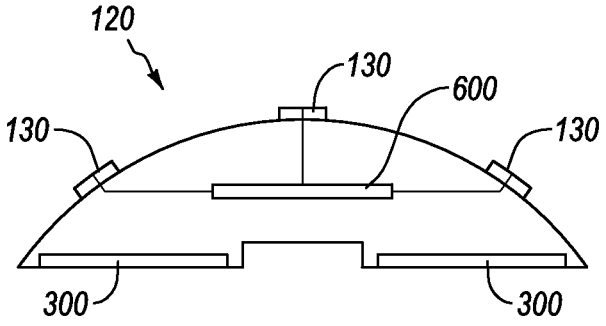
FIG. 6B illustrates a cross-sectional view of the lighting apparatus of FIG. 6A.

FIG. 6B illustrates a cross-sectional view of the lighting apparatus of FIG. 6A. In at least one implementation, the wheel cap 120 can also comprise a battery 600 that powers the one or more light sources 130. Additionally, wheel cap 120 is depicted as comprising attachment points 300 that can attach the wheel cap 120 to a skate wheel, either magnetically or through some other form of attachment.

Accordingly, in at least one implementation of the present invention, a wheel cap 120 can comprise an internal power source that is not a generator. In the case of a battery 600, the battery 600 may be changeable, or the battery may be integrated such that a new wheel cap 120 is required once the battery is expired.

Figure 7:
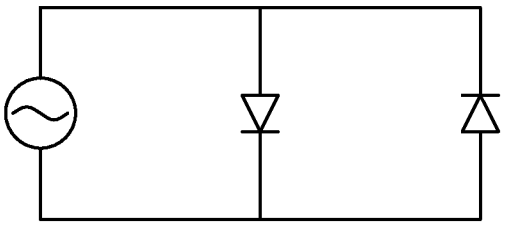
FIG. 7 illustrates a simplified circuit diagram in accordance with an implementation of the present invention.

FIG. 7 illustrates a simplified circuit diagram in accordance with an implementation of the present invention. Specifically, FIG. 7 depicts an implementation of a circuit configuration of the present invention. The depicted simplified circuit comprises a power source and two LEDs. As used within this figure, the power source may comprise a battery, a generator, a power cell, or any other suitable electrical power source. The two LEDs are positioned in opposite directions. As such, if the power source produces a cyclic current, the two LEDs will alternatingly produce light. In an alternative implementation, the power source produces a constant voltage and current such that the LEDs are all constantly active.

While LEDs have been used as an exemplary light source, alternative implementations may utilize other forms of light. For example, a skater may desire to attach laser to the circuit. In at least one implementation, a laser may produce attractive and interesting visuals as it illuminates dust that is kicked up by the skate wheels 110.

Accordingly, various implementations of the present invention provide a system for illuminating skaters. In particular, implementations of the present invention provide a wheel cap 120 that can include a self-powering generator to power one or more light sources 130. Additional implementations may comprise a battery that provides power to the light sources 130.

Additionally, implementations of the present invention may allow a skater to use any skate wheels of their choice by simply attaching a wheel cap 120 to the skate wheel 110. Further, in at least one implementation of the present invention, a wheel cap 120 can comprise an internal generator that attaches to various portions of a skate wheel 110 using magnetic attachments. As such, the spinning skate wheels can power the light sources, while at the same time the wheel cap 120 can be easily applied to and removed from a skate wheel 110.

Although the subject matter has been described in language specific to structural features and/or methodological acts, it is to be understood that the subject matter defined in the appended claims is not necessarily limited to the described features or acts described above, or the order of the acts described above. Rather, the described features and acts are disclosed as example forms of implementing the claims.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. A skate wheel cap and light apparatus for generating a light source, the skate wheel cap comprising:

an outer skate wheel cap structure, wherein the outer skate wheel cap structure comprises:

a first attachment point that is configured to attach to a portion of a skate wheel bearing that is rotationally in sync with a rotation of a skate wheel, wherein the first attachment point comprises a magnet that magnetically couples to the portion of the skate wheel bearing that rotates with the skate wheel, and a first portion of a generator;

an inner skate wheel cap structure, wherein the inner skate wheel cap structure is circumferentially surround by the outer skate wheel cap structure and further wherein the inner skate wheel cap structure comprises:

a second attachment point that is configured to attach to a portion of the skate wheel bearing or a portion of an axle that is not rotationally in sync with a rotation of the skate wheel, and a second portion of the generator; and a light source electronically coupled to the generator.

2. The skate wheel cap and light apparatus recited in claim 1, wherein the second attachment point comprises a magnet that magnetically couples to the portion of the skate wheel bearing that is rotationally stationary with respect to the skate wheel.

3. The skate wheel cap and light apparatus recited in claim 1, wherein the second attachment point comprises a magnet that magnetically couples to the portion of the axle that is rotationally stationary with respect to the skate wheel.

4. The skate wheel cap and light apparatus recited in claim 3, wherein the portion of the axle comprise an axle nut.

5. A skate wheel cap and light apparatus for generating a light source, the skate wheel cap comprising:

an outer skate wheel cap structure, wherein the outer skate wheel cap structure comprises a first attachment point that is configured to attach to a portion of a skate wheel;

a power source integrated within the outer skate wheel cap structure; and a light source electronically coupled to the power source, wherein the first attachment point comprises a magnet.

* * * * *